United States Patent [19]

Taneda et al.

[11] 4,244,539

[45] Jan. 13, 1981

[54] PERFECT LAYER COIL WINDING APPARATUS

[75] Inventors: Yukinori Taneda, Yokohama; Takashi Kobayashi, Fujisawa; Kiyoshi Yano, Yokohama; Mitsunobu Isobe, Machida; Noboru Sugimoto, Yokosuka, all of Japan

[73] Assignee: Hitachi, Ltd., Japan

[21] Appl. No.: 44,338

[22] Filed: May 31, 1979

[30] Foreign Application Priority Data

May 31, 1978 [JP] Japan ..... 53-64340

[51] Int. Cl.[3] ..... B65H 54/28

[52] U.S. Cl. ..... 242/158 R; 242/158.2

[58] Field of Search ..... 242/158 R, 158 F, 158.2, 242/158.4 R, 25 R, 7.14, 7.15, 7.16

[56] References Cited

U.S. PATENT DOCUMENTS

| | | | |
|---|---|---|---|
| 2,900,145 | 8/1959 | Hanson | 242/158.2 |
| 3,433,434 | 3/1969 | Latter | 242/158 R |
| 3,544,035 | 12/1970 | Woolever | 242/158 R |
| 3,822,831 | 7/1974 | Marcum, Jr. | 242/158 R X |
| 3,951,355 | 4/1976 | Morioka et al. | 242/158 R |
| 4,022,391 | 5/1977 | Stein et al. | 242/158 R X |
| 4,086,472 | 4/1978 | Sikora | 242/158 R |

FOREIGN PATENT DOCUMENTS

| | | | |
|---|---|---|---|
| 2250966 | 4/1974 | Fed. Rep. of Germany | 242/158.2 |
| 2616068 | 10/1977 | Fed. Rep. of Germany | 242/158 R |
| 1902722 | 10/1978 | Fed. Rep. of Germany | 242/158 R |
| 935084 | 8/1963 | United Kingdom | 242/158 R |

*Primary Examiner*—Stanley N. Gilreath
*Attorney, Agent, or Firm*—Craig and Antonelli

[57] ABSTRACT

A perfect layer coil winding apparatus capable of automatically forming a perfect layer coil from the initial stage of winding operation without being affected by non-uniformity in diameter of a wire and width of a bobbin for winding the wire thereon is disclosed which performs the following operation: the width of the bobbin is calculated from the position of each of two flanges which is detected by each of two electric micrometer, the number of turns per layer is calculated from the width of bobbin and the diameter of wire, the winding width of the bobbin required to conduct the perfect layer coil winding from the number of turns per layer to adjust the winding width of the bobbin, the supply position of wire is adjusted on the basis of the position of first flange, the diameter of wire and the standby position of a pair of rollers, the bobbin is rotated with the wire pushed against the first flange by a push plate to start the winding operation, and when the degree of rotation of the bobbin reaches a predetermined degree, the push plate is spaced apart from the bobbin and the supply position moves in synchronism with the rotation of the bobbin while following a position on the bobbin at which the wire is wound round the wire, with the delay of a predetermined amount.

4 Claims, 7 Drawing Figures

PERFECT LAYER COIL WINDING APPARATUS

BACKGROUND OF THE INVENTION

The present invention relates to perfect layer coil winding apparatuses for making perfect layer coils in which a wire is wound round a bobbin so as to form a large number of parallel turns.

The term "perfect layer coil" used here and hereinafter is defined to mean a coil that is formed in such a manner that, placing in close contact with the turn already wound on a coil bobbin, the next turn is wound one after another successively along the axial direction of the bobbin.

As a winding apparatus for forming the perfect layer coils there has been hitherto proposed a winding machine in which a pair of rollers for holding a wire therebetween and for defining a supply position of the wire are forced to move in such a manner that the supply position of the wire follows a wire winding position on a bobbin with the delay of a predetermined amount to supply the wire to the bobbin with a predetermined angle of lag and to wind the wire along a coil formed by this time on the bobbin so that a desired coil is continuously formed.

In such a winding machine, a pair of rollers for defining the supply position of wire are moved usually by feed means (formed by a combination of screw and nut) in synchronism with the rotation of the bobbin, and are instantaneously displaced by a desired amount and reversed in their moving direction with a solenoid or the like at the end of each layer of the coil to conduct the winding operation for the next layer. The proposed winding machine has a drawback that, when the number of turns per layer is varied due to the non-uniformity in the width of bobbin or the diameter of wire, the position of wire which is wound round the bobbin falls into disorder. Further, since the wire has to be wound closely along a flange of the bobbin at the initial stage of the winding operation in order to form a perfect layer coil, it is required to manually form first one or two turns prior to an automatic winding operation, and thus the winding machine is very low in operation efficiency.

SUMMARY OF THE INVENTION

An object of the present invention is to provide a perfect layer coil winding apparatus which can automatically form perfect layer coils without being affected by the non-uniformity in the diameter of wire or the winding width of bobbin to which the wire is wound.

In order to attain the above and other objects, according to the present invention, there is provided a perfect layer coil winding apparatus in which the width between flanges provided on both ends of a bobbin, which is supported by winding means and whose winding width is adjustable, is measured together with the diameter of a wire wound on the bobbin, the number (an integer) of turns per layer is calculated from the diameter of wire and the width of bobbin which is obtained from the positions of the flanges, a winding width of bobbin required for forming a perfect layer coil having the calculated number of turns per layer is calculated, the position of at least one of the flanges is adjusted to obtain the calculated winding width, the initial portion of the wire is fixed to one of the flanges along which the winding operation starts, the supply position of wire is so set as to supply the wire to the bobbin along the above-mentioned flange and in a direction perpendicular to the axis of the bobbin, the bobbin is rotated while detecting the degree of rotation to start the winding operation simultaneously with the detection of a predetermined degree of rotation made by the bobbin, the supply position of wire is moved in the direction parallel to the axis of the bobbin in synchronism with the rotation of the bobbin in order to conduct the winding operation in such a manner that the supply position of wire is moved with the delay of a predetermined amount for the position at which the wire is wound on the bobbin, and when the above-mentioned number of turns is given to a layer of the coil and the winding operation is turned to the next layer, the supply position of wire is moved to such a position as supplying the wire in a direction perpendicular to the axis of the bobbin at a position on the bobbin at which the first turn of the next layer is placed, and then is reversed in its moving direction in order to continue the winding operation of the next layer in a manner that the supply position of wire follows the position at which the wire is wound on the bobbin, with the delay of the predetermined amount.

DESCRIPTION OF THE PREFERRED EMBODIMENT

An embodiment of a perfect layer coil winding apparatus according to the present invention will be explained hereinafter in conjunction with the accompanying drawings.

Winding means

Figure 1:
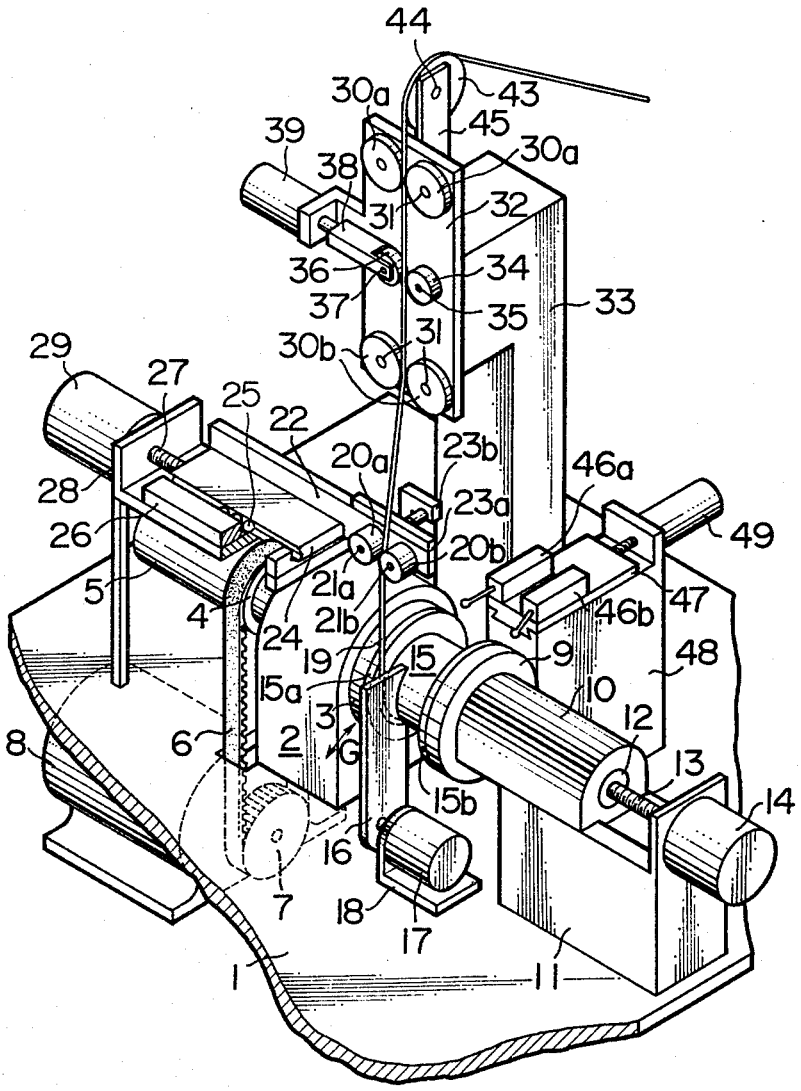
FIG. 1 is a perspective view showing a main part of an embodiment of a perfect layer coil winding apparatus according to the present invention.

Referring to FIG. 1, the winding means which support and rotate a bobbin to perform the winding operation, are provided with a rotable shaft 3 supported by a bearing 2 which is fixed on a base 1. A timing pulley 4 fixed to one end of the shaft 3 is connected through a timing belt 6 to a timing pulley 7 fixed to the shaft of a motor 8 which is placed beneath the base 1, and thus the shaft 3 is rotated with the rotation of the motor 8. A table 11 is fixed on the base 1 face to face with the bearing 2, and supports a tail stock 10 in such a manner that the tail stock 10 is free to slide on the table 11. A rotatable tail stock shaft 9 is supported by the tail stock 10 with the axis thereof coincident with the axis of the shaft 3. A nut 12 fixed to one end of the tail stock 10 is threaded onto a screw 13 connected with the rotary shaft of a stepping motor 14 which is fixed to the table 11, in order to slide the tail stock 10 in the axial direction of the shaft 3 by the rotation of the stepping motor 14.

The axially end surface of the shaft 3 facing the tail stock shaft 9 is preferably formed with a diametrically extending groove (not shown) and the axially end surface of the tail stock shaft 9 facing the shaft 3 is preferably provided with a tongue-like protrusion (not shown) which may fit into the groove when the tail stock shaft 3 is moved to the shaft 3. The tongue-like protrusion is diametrically slidable in the groove. Under the thus coupled condition between these shafts 3 and 9, the rotation of the shaft 3 is transmitted to the tail stock shaft 9 through the engagement of the groove and the tongue-like protrusion.

A bobbin

Figure 3:
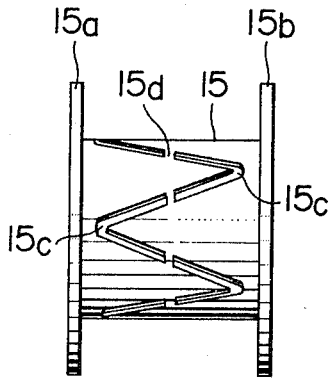
FIG. 3 is an elevational view showing an example of a bobbin having a variable width used in the present invention.

A bobbin 15 is provided with flanges 15*a* and 15*b* at both ends of its drum portion on which a wire 19 is wound. A plurality of groups of approximately dog-legged holes 15*c* are alternately formed in the drum portion of the bobbin 15, as shown in FIG. 3, and a thin frame 15*d* is provided between the holes 15*c*. Accordingly, when the flanges 15*a* and 15*b* are pushed from the outside in the axial direction of the bobbin 15, the frame 15*d* is deformed and the spacing between the flanges 15*a* and 15*b* can be changed.

A case that the winding operation starts from the side of the flange 15, will be described hereinafter.

Push means for the initial stage of winding operation

The means for pushing the wire 19 at the initial stage of winding operation is made up of a rotary pneumatic cylinder 17 (hereinafter simply referred to as a cylinder ) which is fixed through support member 18 to a predetermined position on the base 1, and a push plate 16 fixed to the rotary shaft of the cylinder 17. When the cylinder 17 is rotated, the push plate 16 is interposed between the flanges 15*a* and 15*b* of the bobbin 15 which is supported by the winding means, and pushes the wire 19 against the flange 15*a* to wind the wire 19 along the flange 15*a*.

Feed means

For the feed means is provided a bracket 28 which is fixed to the base 1 at a predetermined position. On the upper surface of the bracket 28 is mounted a table 24 which is interposed through steel balls 25 between a pair of parallel guides 26 fixed to the upper surface of the bracket 28 and is free to slide on the upper surface in a direction parallel to the axis of the bobbin 15 supported by the winding means. A female screw formed in a side surface of the table 24 is threaded onto a screw 27 connects with the shaft of a stepping motor 29 which is fixed to one end of the bracket 28, so that the table 24 can slide in the direction parallel to the axis of the bobbin 15 with the rotation of the stepping motor 29. A supporting plate 22 is fixed to the table 24, and a pair of rollers 20*a* and 20*b* for holding the wire 19 therebetween are supported with a predetermined spacing therebetween by pins 21*a* and 21*b* fixed to one end of the supporting plate 22. The supply position of the wire 19 is defined by the rollers 20*a* and 20*b*. Accordingly, the supply position of wire can follow the position at which the wire 19 is wound on the bobbin 15, by moving the table 24 in the direction parallel to the axis of the bobbin 15 in synchronism with the rotation of the bobbin 15 which is given by the winding means.

Diameter measuring means for wire

For the means for measuring the diameter of the wire 19 there is provided a stand 33 fixed to the base 1 and a base 32 which is fixed to the stand 33 and is placed above the bobbin 15 supported by the winding means. The diameter measuring means are arranged between a pair of rollers 30*a* supported in a rotatable manner by pins 31 at an upper end of the base 32 and another pair of rollers 30*b* supported in a rotatable manner by pins 31 at a lower end of the base 32. Two rollers included in each pair are placed opposite to each other with a predetermined spacing therebetween. The diameter measuring means include a reference roller 34, a differential transformer or potentiometer 39 and a measuring roller 36. The reference roller 34 is supported in a rotatable fashion by a pin 35 fixed to the base 32, the differential transformer or potentiometer 39 is supported by the base 32 face to face with the reference roller 34, and the measuring roller 36 is supported in a rotatable fashion by a pin 37 at one end of an anvil 38 coupled with a movable member of the differential transformer or potentiometer 39 and moreover is placed face to face with the reference roller 34. The wire 19 which is held between the rollers 30*a* and between the rollers 30*b* and moves on a predetermined path while making contact with the outer circumference of the reference roller 34, is pushed at a predetermined pressure by the measuring roller 36 and is thus held between the reference roller 34 and the measuring roller 36 to measure the diameter of the wire 19. Further, a plate 45 is fixed to the base 32, and a guiding roller 43 is supported through a pin 44 by the plate 45 in a rotatable fashion. The roller 43 leads the wire 19 which is to be supplied to the winding means, to the rollers 30*a*.

Means for detecting the degree of rotation of bobbin

The means for detecting the degree of rotation of the bobbin 15 are formed by a rotary encoder 5 which is supported by the base 1 face to face with one end of the shaft 3 and whose rotary shaft is coupled with the shaft 3 to detect the degree of rotation of the shaft 3 equivalent to the degree of the rotation of the bobbin 15.

Means for detecting an origin for the supply position of wire

The origin detecting means for detecting the standby position of the rollers 20*a* and 20*b*, which are included in the feed means and define the supply position of the wire 19, are given by a detector, for example, a magnetic scale, made up of a storage element 23*a* and a read-out head 23*b*. The storage element 23*a* is fixed to one end portion of the supporting plate 22 and stores therein predetermined magnetic signals, and the read-out head 23*b* is supported face to face with the storage element 23*a* by the bracket 28 and reads the magnetic signals out of the storage element 23*a*.

Position detecting means

The position detecting means for detecting the position of each of the flanges 15*a* and 15*b* on both ends of the bobbin 15 which is held by the winding means, are placed face to face with the bobbin 15. In more detail, on a table 48 fixed to the base 1 is mounted a slide base 47 which is free to slide on the table 48 in the direction perpendicular to the axis of the bobbin 15. A pair of detectors 46*a* and 46*b* are fixed to the slide base 47 with a predetermined spacing therebetween, and each of the detectors is provided with a contact which projects forward from the slide base 47. The slide base 47 is connected with a rod of a cylinder 49 fixed to the table 48, and the actuation of the cylinder 49 causes the slide base 47 to slide on the table 48. When the cylinder 49 is actuated, the slide base 47 moves forward and thus respective contacts of the detectors 46*a* and 46*b* make contact with the flanges 15*a* and 15*b* of the bobbin 15 supported by the winding means to detect the position of each of the flanges 15*a* and 15*b*. An electric micrometer or the like can be used for each of the detectors 46*a* and 46*b*.

Control means

Figure 2:
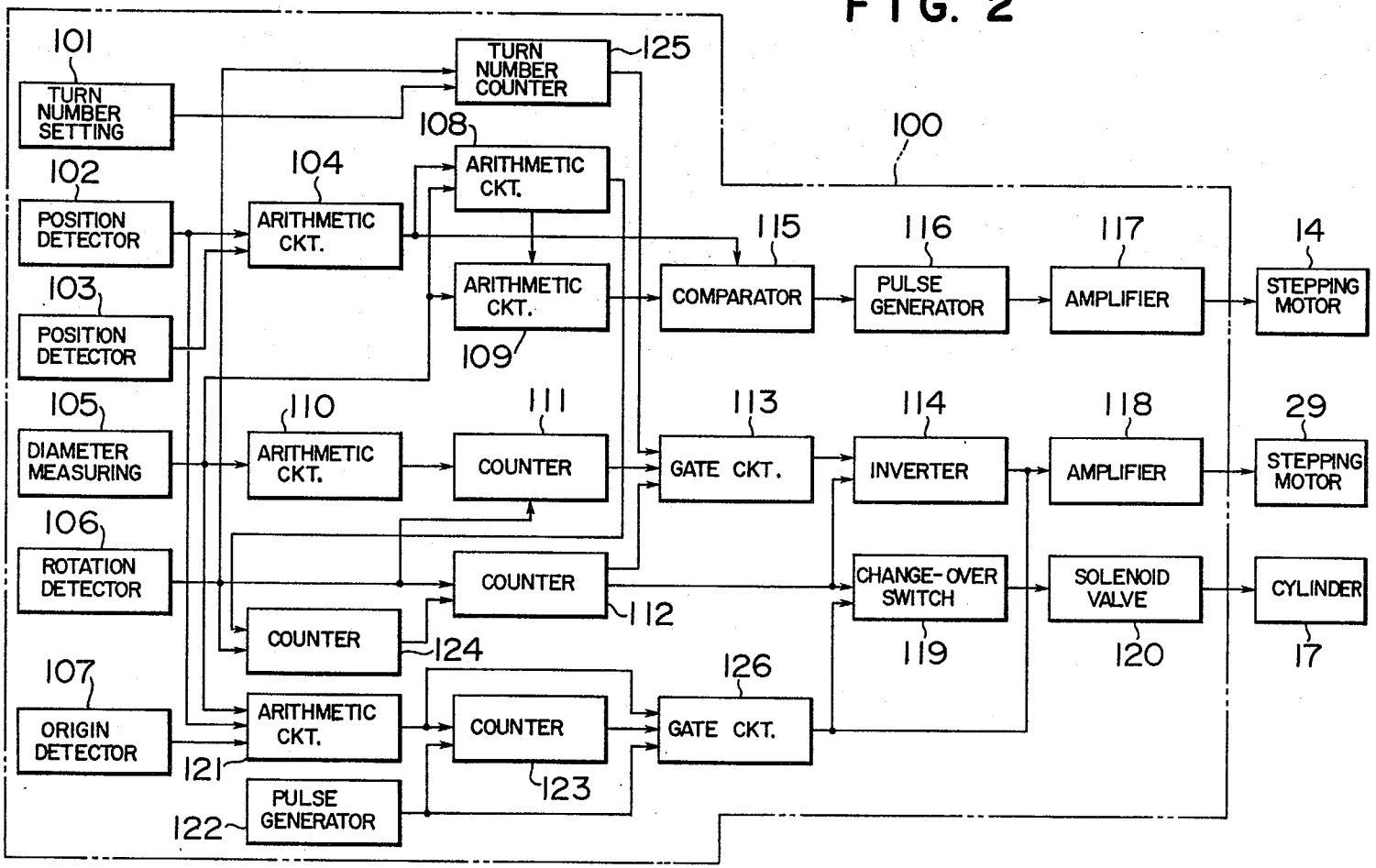
FIG. 2 is a block diagram for showing a control circuit included in the above-mentioned embodiment.

Referring to FIG. 2, the control means 100 include, on the input side thereof, a number-of-turn setting circuit 101 for setting the total number of turns in which the wire 19 is wound round the bobbin 15, a position detecting circuit 102 connected to the detector 46*a* for detecting the position of the flange 15*a* of the bobbin 15 which is supported by the winding means, a position detecting circuit 103 connected to the detector 46*b* for detecting the position of the flange 15*b* of the bobbin 15, a diameter-of-wire measuring circuit 105 connected to the differential transformer or potentiometer 39 of the diameter measuring means, a degree-of-rotation detecting circuit 106 connected to the rotary encoder 5 for detecting the degree of rotation of the bobbin 15, an origin detecting circuit 107 connected to the read-out head 23*b* of the origin detecting means which detect the origin for the supply position of the wire 15, and a pulse generating circuit 122 for generating pulses having a predetermined pulse interval. An arithmetic circuit 104 is connected to the position detecting circuits 102 and 103 and calculates the width of the bobbin 15 on the basis of the results of the position detection of the flanges 15*a* and 15*b* supplied from the circuits 102 and 103. An arithmetic circuit 108 is connected to the arithmetic circuit 104 and the diameter-of-wire measuring circuit 105, and calculates the number (an integer) of turns per layer which is allowed on the bobbin 15 in the case of perfect layer coil winding, from the width of the bobbin 15 and the diameter of the wire 19 which are delivered from the circuits 104 and 105, respectively. An arithmetic circuit 109 is connected to the diameter-of-wire measuring circuit 105 and the arithmetic circuit 108, and calculates the winding width of the bobbin 15 required to conduct the perfect layer coil winding, from the diameter of the wire 19 and the number of turns per layer which are delivered from the circuits 105 and 108, respectively. A comparator circuit 115 is connected to the arithmetic circuits 104 and 109, and compares the width of the bobbin 15 delivered from the circuit 104 with the winding width of the bobbin 15 delivered from the circuit 109 to deliver an amount of adjustment by which the width of bobbin 15 has to be varied. A pulse generating circuit 116 is connected to the comparator circuit 115, and the number of pulses delivered from the circuit 116 corresponds to the amount of adjustment for the width of the bobbin 15 which is delivered from the comparator circuit 115. An amplifier circuit 117 is connected to the pulse generating circuit 116, and amplifies the amplitude of the pulses supplied from the circuit 116 to an amplitude capable of driving a stepping motor 14 in order to apply the amplified pulses to the stepping motor 14. Upon the application of the pulses, the stepping motor 14 begins to turn and rotates the screw 13 threaded onto the nut 12, to move the tail stock 10 toward the shaft 3, push the flange 15*b* of the bobbin 15 with the tail stock shaft 9, and adjust the winding width of the bobbin 15. At this time, the frames 15*d* of the bobbin 15 are deformed and the width of each hole 15*c* becomes narrower. An arithmetic circuit 110 is connected to the diameter-of-wire measuring circuit 105, and calculates, on the base of the diameter of the wire 19 delivered from the circuit 105, a rotational frequency dividing ratio which indicates a ratio of the number of pulses delivered from the rotary encoder 5 per one turn (or one revolution) of the bobbin 15 to the number of pulses required to move the rollers 20*a* and 20*b* of the feed means by the diameter of the wire 19. A rotational-frequency-dividing-ratio counter 111 is connected to the degree-of-rotation detecting circuit 106 and the arithmetic circuit 110, and sets therein the rotational frequency dividing ratio delivered from the circuit 110 to convert the number of pulses supplied from the circuit 106 into the number of pulses for moving the rollers 20*a* and 20*b* on the basis of the rotational frequency dividing ratio. A number-of-turn counter 124 is connected to the degree-of-rotation detecting circuit 106 and the arithmetic circuit 108, compares the number of turns supplied from the circuit 108 with the number of turns which is converted from the number of pulses delivered from the circuit 106, and delivers a signal indicating that the winding operation for one layer is completed when the above-mentioned two kinds of numbers of turns are coincident with each other. A counter 112 is connected to the degree-of-rotation detecting circuit 106 and the number-of-turn counter 124, counts up pulses delivered from the circuit 106, delivers a single pulse signal and ceases to count up the pulses when the number of pulses from the circuit 106 becomes equal to a predetermined number, and is reset by a signal delivered from the counter 124 to start again the counting operation. A number-of-turn counter 125 is connected to the number-of-turn setting circuit 101 and the degree-of-rotation detecting circuit 106, compares the total number of turns set in the circuit 101 with the number of turns which is converted from the number of pulses supplied from the circuit 106, and delivers an end signal indicating that the winding operation is completed when the total number of turns and the converted number of turns coincide with each other. A gate circuit 113 is connected to the rotational-frequency-dividing-ratio counter 111, the counter 112 and the number-of-turn counter 125, is enabled by the pulse signal delivered from the counter 112 to pass therethrough pulses supplied from the counter 111, and is disabled by the end signal supplied from the counter 125 to stop the passage of the pulses supplied from the counter 111. Incidentally, when the number-of-turn counter 125 delivers the end signal indicating that the winding operation is completed, the motor 8 and the winding machine are turned off. An inverter circuit 114 is connected to the counter 112 and the gate circuit 113, and reverses the polarity of the pulses supplied from the counter 112. An amplifier circuit 118 is connected to counter 112. An amplifier circuit 118 is connected to the inverter circuit 114, and amplifies the amplitude of the pulses supplied from the circuit 114 to an amplitude capable of driving the stepping motor 29 to apply the amplified pulses to the stepping motor 29. The stepping motor 29 performs the normal or reverse rotation in synchronism with the rotation of the bobbin 15 in accordance with the number and polarity of pulses supplied from the amplifier circuit 118 to move the rollers 20*a* and 20*b* of the feed means forward or backward in the direction parallel to the axis of the bobbin 15. An arithmetic circuit 121 is connected to the position detecting circuit 102, the diameter-of-wire measuring circuit 105 and the origin detecting circuit 107, and calculates a distance from the origin to such an initial position of the roller 20*a* that the roller 20*a* can supply the wire 19 to a position on the bobbin at which the wire 19 is first wound, in the direction perpendicular to the axis of the bobbin 15, on the basis of the position of the flange 15*a* of the bobbin 15 supplied from the circuit 102, the diamer of the wire 19 supplied from the circuit 105 and the position of the roller 20*a* (or 20*b*) supplied from the circuit 109, in order to calculate and deliver the number of pulses corresponding to the above-mentioned distance. A counter 123 is connected to the arithmetic circuit 121 and the pulse generating circuit 122, sets therein the number of pulses supplied from the circuit 121, counts up pulses supplied from the circuit 122, and delivers a single signal when the set number of pulses coincides with the number of pulses supplied from the circuit 122. A gate circuit 126 connected to the arithmetic circuit 121, the pulse generating circuit 122 and the counter 123, is enabled by the pulses supplied from the circuit 121 to pass therethrough pulses supplied from the circuit 122, and is disabled by the signal delivered from the counter 123 to stop the passage of the pulses from the circuit 122. The pulses having passed through the gate circuit 126 are applied to and amplified by the amplifier circuit 118 to apply the amplified pulses to the stepping motor 29. Then, the stepping motor 29 turns in correspondence with the applied number of pulses to move the roller 20*a* so as to place the contact between the roller 20*a* and the wire 19 in a plane containing therein the inner side face of the flange 15*a*. Thus, the wire 19 can be supplied to the position on the bobbin 15 at which the wire 19 is first wound, in the direction perpendicular to the axis of the bobbin 15. A change-over switch 119 is connected to the counter 112 and the gate circuit 126, is put in the on-state by the pulses supplied from the circuit 126, and is put in the off-state by the pulse signal delivered from the counter 112. A solenoid valve 120 is connected to the change-over switch 119, and opens or closes the path of the compressed air supplied to the cylinder 17 of the push means according as the switch 119 is put in the on- or off-state.

Figure 4:
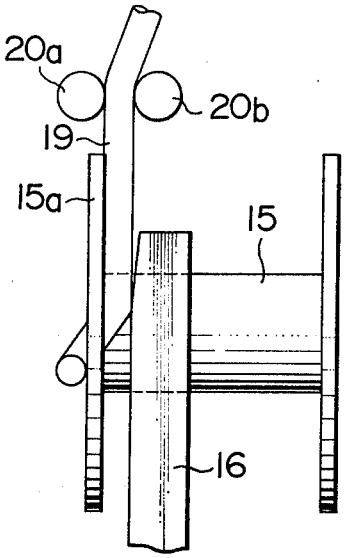
FIG. 4 is an elevational view for showing an initial state of the winding operation.
Figure 5:
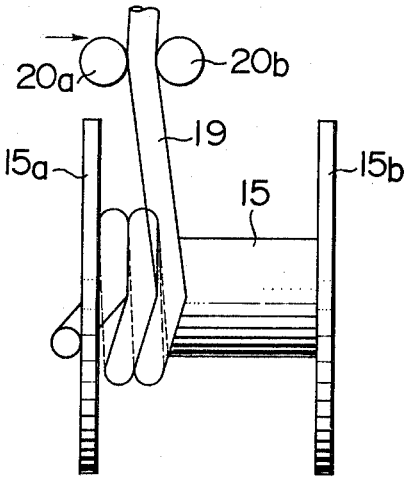
FIG. 5 is an elevational view for showing an intermediate state of the winding operation.

With the circuit arrangement as above, the following operation is performed. Firstly, a total number of turns desired is set in the number-of-turn setting circuit 101, and the number of pulses corresponding to that degree of rotation of the bobbin 15 which is equivalent to the delay of a predetermined amount between the supply position of wire and the winding position on the bobbin, is set in the counter 112. The bobbin 15 is interposed between the shaft 3 and the tail stock shaft 9. Then, the stepping motor 14 is turned on to move the tail stock 10 forward and to push the bobbin 15 with such a pressure as not to change the width of the bobbin 15. Thus, the flanges 15*a* and 15*b* are kept in close contact with the shaft 3 and the tail stock shaft 9, respectively. Next, the initial end of the wire 19 which is held between the rollers 20*a* and 20*b*, is fastened at a predetermined position on the flange 15*a*. In this state, the pneumatic cylinder 49 is actuated to move the detectors 46*a* and 46*b*. Thus, the contacts of the detectors are put in contact with the facing surfaces of the flanges 15*a* and 15*b* to measure the position of each of the flanges 15*a* and 15*b*. Then, the position detecting circuits 102 and 103 detect the coordinates Wa and Wb of the flanges 15*a* and 15*b* in the direction parallel to the axis of the bobbin 15, and the arithmetic circuit 104 calculates the width W ($W=Wa-Wb$) of the bobbin 15. While, the diameter D of the wire 19 which is placed between the reference roller 34 and the measuring roller 36, is measured by the differential transformer or potentiometer 39, and is detected by the diameter-of-wire measuring circuit 105. The arithmetic circuit 108 calculates the number n of turns per layer from the width W of the bobbin 15 and the diameter D of the wire 19. (In this case, however, the number n is an integer indicating a quotient in the division W/D and is so determined as to make a residue in the division W/D less than D2.) Subsequently, the arithmetic circuit 109 calculates the winding width w($w=(n+\frac{1}{2})D$) of the bobbin 15 required to conduct the perfect layer coil winding from the number n of turns per layer and the diameter D of the wire 19. The comparator circuit 115 compares the width W and the winding width w of the bobbin 15 which are supplied from the arithmetic circuits 104 and 109 respectively, to deliver the amount $A_1$($A_1=W-w$) of adjustment by which the width of the bobbin 15 is varied. The pulse generating circui 116 produces pulses to the number corresponding to the amount $A_1$ of adjustment to apply the pulses to the stepping motor 14 through the amplifier circuit 117. The stepping motor 14 turns in correspondence with the number of pulses applied. Thus, the tail stock 10 is moved toward the shaft 3 with the rotation of the screw 13, and the flange 15*b* is pushed by the tail stock shaft 9 to adjust the winding width W of the bobbin 15. The origin detecting circuit 107 detects the origin S or standby position of the roller 20*a* (or 20*b*) of the feed means. The arithmetic circuit 121 calculates, from the coordinate Wa of the flange 15*a* supplied from the position detecting circuit 102, the diameter D of the wire 19 supplied from the diameter-of-wire measuring circuit 105 and the origin S of the roller 20*a* (or 20*b*) supplied from the origin detecting circuit 107, an amount $$A_2\,(A_2 = S - Wa + \frac{D}{2})$$

of movement of the roller 20*a* required to move the roller 20*a* to the supply position shown in FIG. 4 and capable of supplying the wire 19, in the direction perpendicular to the axis of the bobbin 15, to that position s on the bobbin 15 at which the wire 19 is first wound. The arithmetic circuit 121 delivers pulses in the number corresponding to the amount $A_2$ of movement. The number of pulses delivered from the circuit 121 is set in the counter 123. Simultaneously, the gate circuit 126 is enabled, namely, put in the onstate to pass the pulses from the pulse generating circuit 122 and to apply the pulses to the stepping motor 29 through the amplifier circuit 118. The stepping motor 29 turns in correspondence with the number of pulses applied thereto. Thus, the table 24 is moved with the rotation of the screw 27 to move the rollers 20*a* and 20*b* to the supply position s. When the number of pulses set in the counter 123 becomes coincident with the number of pulses which are supplied from the pulse generating circuit 122 and are counted up by the counter 123, the counter 123 delivers a signal to disable the gate circuit 126. The pulses having passed through the gate circuit 126 are applied to the change-over switch 119 to close the switch 119, and an electric current is thereby applied to the solenoid valve 120. Thus, the solenoid valve 120 opens to supply the compressed air to the cylinder 17. The introduction of the compressed air into the cylinder 17 rotates the shaft of the cylinder 17, and therefore the push plate 16 turns round. Thus, the push plate 16 is interposed between the flanges 15*a* and 15*b* to push the wire 19 against the flange 15*a*, as shown in FIG. 4. The arithmetic circuit 110 calculates the rotational frequency dividing ratio on the basis of the diameter D of the wire 19 supplied from the diameter-of-wire measuring circuit 105 to set the ratio in the rotational-frequency-dividing-ratio counter 111. In this state, the motor 8 is turned on to commence the winding operation. At the beginning of the winding operation, the wire 19 is wound along the flange 15*a*, since the winding position is defined by the push plate 16. The rotation of the bobbin 15 is detected by the rotary encoder 5, and the degree-of-rotation detecting circuit 106 delivers pulses to the number corresponding to the degree of rotation of the bobbin 15. The above pulses are counted up by the counter 112, and the counter 112 ceases to count up the pulses and delivers a single signal when the number of counted pulses becomes equal to the number previously set in the counter 112. The signal from the counter 112 is applied to the gate circuit 113, the inventer circuit 114 and the changeover switch 119. The switch 119 opens upon the application of the above signal to interrupt the electric current for the valve 120. Thus, the solenoid valve 120 shuts to interrupt the supply of compressed air into the cylinder 17 and to exhaust the compressed air within the cylinder 17 to the atmosphere. Thus, the cylinder turns round and the push plate 16 is rotated to be spaced apart from the bobbin 15. The gate circuit 113 is enabled by the signal from the counter 112 to apply the pulses from the rotational-frequency-dividing-ratio counter 111 to the inverter circuit 114 through the circuit 113. The inverter circuit 114 defines the polarity of the pulses from the gate circuit 113 by the signal from the counter 112, and the pulses thus defined are applied to the stepping motor 29 through the amplifier circuit 118. The stepping motor 29 turns with a predetermined sense of rotation in correspondence with the polarity and number of pulses delivered from the amplifier circuit 118, to move the slide table 24 with the rotation of the screw 27. Since the rollers 20*a* and 20*b* move together with the slide table 24, the supply position of the wire 19 moves in the direction parallel to the axis of the bobbin 15 with the delay of a predetermined amount for the winding position on the bobbin 15, as shown in FIG. 5.

Figure 7:
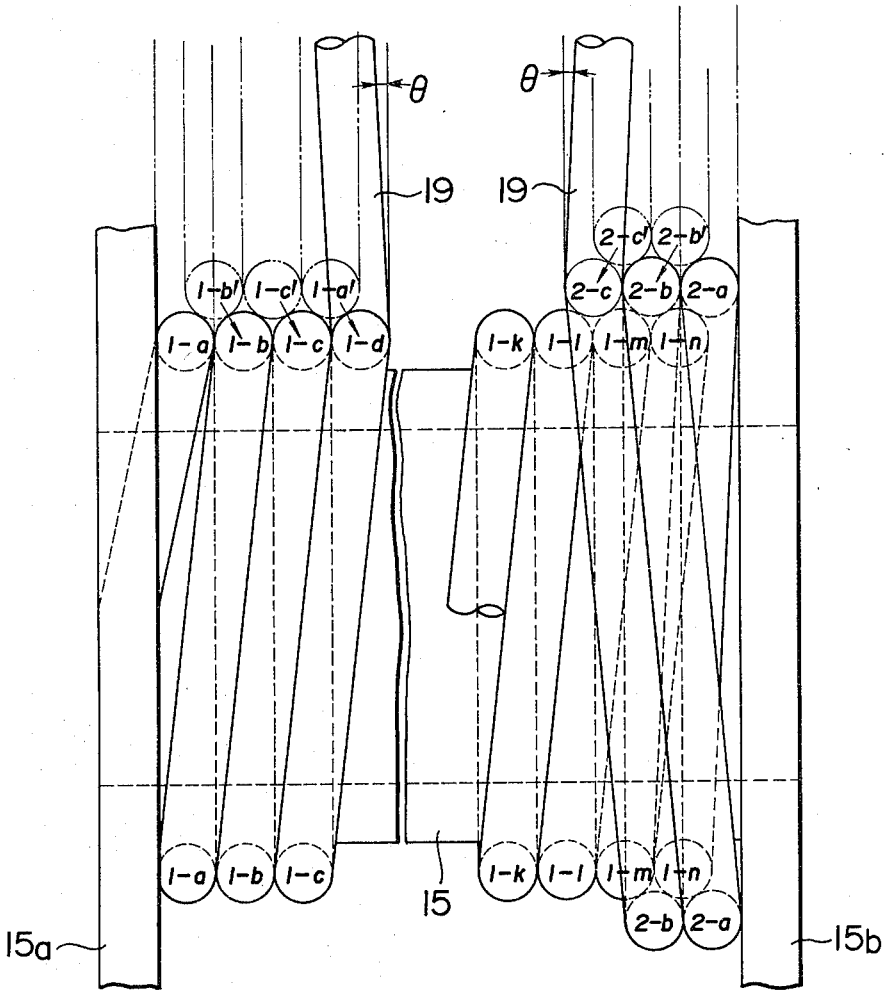
FIG. 7 is an enlarged view for showing a manner in which a wire is wound to form a perfect layer coil.

For example, in the case that the counter 112 delivers the signal when the bobbin 15 has rotated by a 180-degree angle, during the first one half turn of the bobbin 15, the winding operation is controlled by the push plate 16 and the wire 19 is wound in close contact with the flange 15*a*. When the bobbin 15 has just rotated by a 180-degree angle, the push plate 16 is spaced apart from the bobbin 15, the rollers 20*a* and 20*b* begin to move, and the wire 19 is wound round the bobbin 15 spaced from the flange 15*a*. When the degree of rotation of the bobbin 15 reaches 300 to 360 degrees, the wire 19 is placed on that initial portion of the wire 19 which passes through the flange 15*a* and corresponds to the starting position of the winding operation. At this time, the supply position of the wire 19 has been already moved, and therefore the supply position is shifted from the center of the above-mentioned initial portion of the wire 19 toward the flange 15*b*. Thus, the wire 19 slides down the initial portion to be placed parallel with the initial portion. Simultaneously with the above slide, the portion of the wire 19 which has been wound round the bobbin 15 during the rotation of the bobbin 15 from 180 to 360 degrees, is corrected in position by the tension of the wire 19 to take the shortest path. The subsequent turns of a coil are wound parallel with the first turn to form a perfect layer coil, and turns 1-a, 1-b, 1-c, 1-d, and so on are wound in this order, as shown in FIG. 7. The supply position of the wire 19 follows the winding position with the delay of one half of the diameter D of the wire 19 during the winding operation for the turns 1-b, 1-c, 1-d, and so on. Thus, the angle $\theta$ of inclination of the wire 19 resulting from the slide of the wire 19 indicates the so-called angle of lag.

Figure 6:
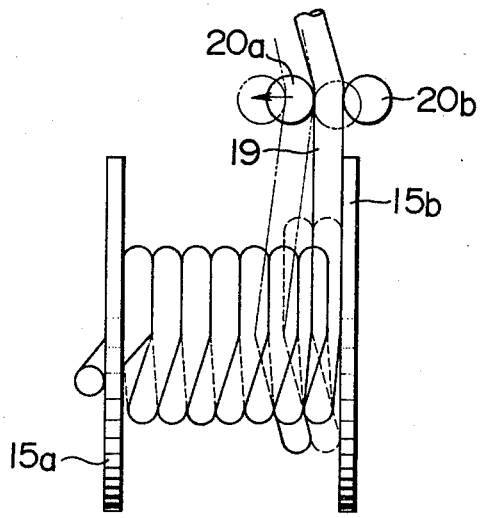
FIG. 6 is an elevational view for showing an final state of the winding operation for a layer of a coil.

When the wire 19 is wound round the bobbin 15 to the number n of turns per layer which is calculated by the arithmetic circuit 108 and is set in the counter 124, the reset signal from the counter 124 is applied to the counter 112. Thus, the counter 112 is reset, and commences again to count up the pulses delivered from the degree-of-rotation detecting circuit 106. Further the counter 112 delivers a single signal which is applied to the gate circuit 113 and the inverter circuit 114, and ceases to count up the pulses, when the number of pulses supplied from the circuit 106 becomes coincident with the number set in the counter 112. At this time, the rollers 20*a* and 20*b* have been moved, as shown in FIG. 6, to the position capable of supplying the wire 19 to the bobbin 15 along the flange 15*b* in the direction perpendicular to the axis of the bobbin 15. The inverter circuit 114 reverses the polarity of the pulses from the gate circuit 113 when applied with the signal from the counter 112, to apply the pulses of reverse polarity to the stepping motor 29 through the amplifier circuit 118. Thus, the stepping motor 29 turns in the reverse sense of rotation, and therefore the rollers 20*a* and 20*b* move in the opposite direction. At this time, the delay of the predetermined amount is given by the counter 112.

In more detail, as shown in FIG. 7, the winding operation for the first layer is conducted in the order of turns 1-a, 1-b, . . . , 1-k, 1-l, 1-m, 1-n, and 2-a, and is completed at the turn 2-a. The end of the first layer is identical with the beginning of the second layer, and is indicated in FIG. 7 by the upper one of circles containing therein reference symbol 2-a. When the winding operation for the first layer is completed, the delay between the supply position of the wire 19 and the winding position on the bobbin 15 is eliminated, and the wire 19 is supplied to the bobbin 15 along the flange 15*b* in the direction perpendicular to the axis of the bobbin 15. Further, when the wire 19 is shifted from the turn 1-n to the turn 2-a, the wire 19 is wound along the preceding turn while being kept in contact with the bobbin 15 during the period of the winding operation corresponding to the first one quarter turn of the bobbin 15. The wire 19 is placed on the preceding turn 1-n for more than one quarter turn of the bobbin 15, and is corrected in position by the tension of the wire 19 to take the shortest path. Thus, the portion of the wire which has been wound in contact with the bobbin 15, is also lifted out of the surface of the bobbin, and a gap is formed between the surface of the bobbin 15 and the end portion of the turn 1-n in such a manner as being gradually enlarged. At this time, the rollers 20*a* and 20*b* stop, and are left as they are till the signal is delivered from the counter 112 by more one half turn of the bobbin 15. During the period when the rollers 20*a* and 20*b* stop, the wire 19 is wound along the flange 15*b* with one half of the cross section of the wire 19 placed on the turn 1-n. When the signal is delivered from the counter 112, the rollers 20*a* and 20*b* begin to move in the direction opposite to the direction for the first layer. When the bobbin 15 further effects one half turn, the supply position of the wire 19 is moved to a position 2-b'. Thus, the wire 19 slides down the turn 2-a, and is wound along the turn 2-a to form the turn 2-b. When the wire 19 is shifted from the turn 2-a to the turn 2-b, the wire 19 pushes the portion of the wire at which the wire 19 is shifted from the turn 1-n to the turn 2-a, reduces the previously-mentioned gap, and takes the shortest path. Subsequently, the wire 19 is wound in the same manner as the first layer to form the second layer. It should be noted that the portion of each turn of the second layer which is parallel to the flanges 15*a* and 15*b* is placed in valleys formed by respective portions of all turns of the first layer which are parallel to the flanges 15*a* and 15*b*.

The above-mentioned winding operation is performed till the predetermined number of turns is obtained. When the number of turns reaches the number N set in the number-of-turn setting circuit 101, the number-of-turn counter 125 delivers the signal indicating that the winding operation is completed, and the signal is applied to the gate circuit 113. Simultaneously, the motor 8 is turned off, and therefore the rotation of the bobbin 15 is stopped. The gate circuit 113 is disabled upon the application of the signal from the counter 125 to prevent the pulses from the rotational-frequency-dividing-ratio counter 111 from passing through the gate circuit 113. Thus, the stepping motor 29 is turned off, and the rollers 20*a* and 20*b* stop.

In the above-mentioned manner, the wire 19 is wound round the bobbin 15 in a desired number of turns to form a perfect layer coil.

According to the present invention, a perfect layer coil can be formed irrespective of the non-uniformity in diameter of the wire 19 and in width of the bobbin 15. Further, the winding operation can be automatically performed from the initial stage thereof and therefore is high in speed, and moreover the coil formed has the highest possible density of wire.

We claim:

1. A perfect layer coil winding apparatus for forming a multi-layered perfect layer coil which includes wire winding means for rotating a bobbin having flanges on both ends thereof to perform a winding operation and provided with a detector for detecting a degree of rotation of said bobbin, said feed means provided with a pair of rollers for holding therebetween a wire to supply said wire to said bobbin and define a supply position of said wire, for moving said supply position forward and backward in a direction parallel to the axis of said bobbin in synchronism with the rotation of said bobbin in such a manner that said supply position follows a winding position for winding said wire round said bobbin thereat with the delay of a predetermined amount on the basis of the output of said detector, further comprising:

said wire winding means including a shaft and a tail stock shaft to hold said bobbin therebetween, the width between said flanges of said bobbin being variable, said tail stock shaft being slidable in the axial direction thereof toward said shaft to compress and adjust said width between said flanges of said bobbin;

position detecting means for detecting the position of each of said flanges of said bobbin held by said wire winding means;

diameter measuring means for measuring the diameter of said wire wound round said bobbin; and control means connected to said position detecting means and said diameter measuring means for calculating the width of said bobbin from the position of each of said flanges detected by said position detecting means and for calculating the number of turns per layer in a perfect layer coil winding and the winding width of said bobbin required to conduct said perfect layer coil winding from said calculated width of said bobbin and the diameter of said wire measured by said diameter measuring means to slide said tail stock shaft toward said shaft and adjust said width of said bobbin to said winding width.

2. A perfect layer coil winding apparatus for forming a multi-layered perfect layer coil which includes wire winding means for rotating a bobbing having flanges on both ends thereof to perform a winding operation and provided with a detector for detecting a degree of rotation of said bobbin, and feed means provided with a pair of rollers for holding therebetween a wire to supply said wire to said bobbin and difine a supply position of said wire, for moving said supply position forward and backward in a direction parallel to the axis of said bobbin in synchronism with the rotation of said bobbin in such a manner that said supply position follows a winding position for winding said wire round said bobbin thereat with the delay of a predetermined amount on the basis of the output of said detector, further comprising:

said wire winding means including a shaft and a tail stock shaft to hold therebetween a bobbin of a variable width, said tail stock shaft being slidable in the axial direction thereof to adjust the width of said bobbin;

push means for the initial stage of said winding operation equipped with a push plate, said push plate being capable of getting near or away said bobbin in a plane parallel to and spaced apart by the diameter of said wire from one of said flanges, said winding operation being first performed on the side of said one flange, said bobbin having said flanges being held by said wire winding means, said push plate being brought near said bobbin at the beginning of said winding operation to push an initial portion of said wire against said one flange and wind said wire along said one flange;

position detecting means for detecting the position of each of said flanges of said bobbin held by said wire winding means;

diameter measuring means for measuring the diameter of said wire wound round said bobbin; and control means connected to said position detecting means and said diameter measuring means for calculating the width of said bobbin from the position of said each flange detected by said position detecting means and for calculating the number of turns per layer in a perfect layer coil winding and the winding width of said bobbin required to conduct said perfect layer coil winding from said calculated width of said bobbin and the diameter of said wire measured by said diameter measuring means to slide said tail stock shaft toward said shaft and adjust said width of said bobbin to said winding width, said control means bringing said push plate of said push means near said bobbin to push said initial portion of said wire against said one flange, said control means keeping said push plate away from said bobbin and starting the movement of said feed means when the degree of rotation of said bobbin reaches a predetermined angle after the start of said winding operation.

3. In a perfect layer coil winding apparatus comprising (a) holding means for holding a bobbin in a manner as being rotatable on the axis thereof, said bobbin being provided with flanges on both ends thereof, a wire being wound round said bobbin between said flanges, and (b) feed means including a pair of rollers for holding at a nip therebetween a portion of said wire to be wound onto said bobbin and for defining the supply position of said wire to said bobbin, and roller moving means for moving said pair of rollers in a direction parallel to the axis of said bobbin and in a manner so that said nip always points to a circumference portion of said bobbin, said motion of said rollers being effected in such a manner that the position of said rollers follows a position on said bobbin at which said wire sent from said rollers is wound round said bobbin, with the delay of a length less than the diameter of said wire, the improvement which comprises (A) a holding mechanism included in said holding means for holding said bobbin in a manner as being rotatable on the axis thereof which the width between said flanges of said bobbin compressed to a length, the intermediate portion of said bobbin sandwiched by said flanges for winding said wire thereon having a variable width and being reduced in width by compressing said bobbin between said flanges, said length being defined by an external control signal; and (B) control means including first, second and third means, said first means detecting the width between said flanges of said bobbin before and after the compression of said bobbin, said bobbin being variable in width and held by said holding mechanism, said second means detecting the diameter of said wire wound round said bobbin, said third means receiving outputs from said first and second means to calculate a required width of said intermediate portion corresponding to a possible number of turns per layer from the width between said flanges prior to said compression given by said first means and the output of said second means, said required width of said intermediate portion being supplied to said holding mechanism as said external control signal, thereby allowing said holding mechanism to hold said bobbin while maintaining the width of said intermediate portion at a predetermined value.

4. An improvement according to claim 3, wherein said holding means further include degree-of-rotation detecting means for detecting the degree of rotation of said bobbin held by said holding means, and initial-position-of-winding defining means getting near and away said bobbin in a plane perpendicular to the axis of said bobbin and spaced apart by the diameter of said wire from one of said flanges along which said winding operation is started; and wherein said control means further include fourth means receiving the output of said degree-of-rotation detecting means for bringing said initial-position-of-winding defining means near said bobbin only during the period when said bobbin rotates in a predetermined degre less than 360 degrees after the start of said winding operation.

* * * * *